United States Patent [19]

Stöhr

[11] Patent Number: 4,712,690

[45] Date of Patent: Dec. 15, 1987

[54] PACKAGE HAVING WELDED SEAM CLOSURE WITH HOT MELT THICKENING

[75] Inventor: Benno Stöhr, Hückelhoven, Fed. Rep. of Germany

[73] Assignee: PKL Papier-und Kunststoff-Werke Linnich GmbH, Dusseldorf, Fed. Rep. of Germany

[21] Appl. No.: 873,136

[22] Filed: Jun. 5, 1986

Related U.S. Application Data

[63] Continuation of Ser. No. 704,128, Feb. 22, 1985, abandoned.

[30] Foreign Application Priority Data

Feb. 25, 1984 [DE] Fed. Rep. of Germany ..... 3406962

[51] Int. Cl.[4] ..... B65D 5/70

[52] U.S. Cl. ..... 206/628; 206/621.2; 206/621.3; 220/270; 229/137; 229/140

[58] Field of Search ..... 229/17 R, 17 G, 52 B, 229/DIG. 6; 206/620, 628, 410, 813; 215/305; 220/269, 270

[56] References Cited

U.S. PATENT DOCUMENTS

| | | | |
|---|---|---|---|
| 2,185,604 | 1/1940 | Moore | 206/628 |
| 3,347,444 | 10/1967 | Rausing et al. | 229/17 R |
| 3,819,106 | 6/1974 | Schuster | 383/35 |
| 3,866,782 | 2/1975 | Westfall | 215/305 |
| 4,346,299 | 8/1982 | Mitteldorf et al. | 206/628 |
| 4,433,784 | 2/1984 | Kjelgaard | 229/17 R |
| 4,448,326 | 5/1984 | Brochman | 206/628 |

FOREIGN PATENT DOCUMENTS

| | | | |
|---|---|---|---|
| 506556 | 11/1951 | Belgium | 215/305 |
| 897124 | 4/1972 | Canada | 229/17 G |
| 2214665 | 8/1973 | Fed. Rep. of Germany | 229/17 G |
| 3301086 | 7/1984 | Fed. Rep. of Germany | . |
| 1242877 | 8/1960 | France | 229/17 R |
| 630362 | 12/1961 | Italy | 229/17 R |
| 51486 | 10/1941 | Netherlands | 215/305 |

*Primary Examiner*—Stephen Marcus
*Assistant Examiner*—Gary E. Elkins
*Attorney, Agent, or Firm*—Sprung Horn Kramer & Woods

[57] ABSTRACT

A package made out of a sheet material like paper, cardboard, etc., and with a welded-seam closure in the upper surface, especially a parallelepipedal package for liquid, made out of a material that is a composite of paper and plastic and having folded triangular flaps that can be folded down against the walls. In order to provide a package that is even easier to open and that in particular will be cheaper to manufacture with respect to the costs of materials, at least one side of the welded-seam closure has a thickening that facilitates ripping into it or ripping it out.

15 Claims, 4 Drawing Figures

PACKAGE HAVING WELDED SEAM CLOSURE WITH HOT MELT THICKENING

This application is a continuation of application Ser. No. 704,128, filed 2/22/85, now abandoned.

BACKGROUND OF THE INVENTION

The present invention relates to a package made out of a sheeted material like paper, cardboard, etc. and with a welded-seam closure in the upper surface, and especially to a parallelepipedal package for liquid, made out a material that is a composite of paper and plastic and having folded triangular flaps that can be folded down against the walls.

A package of this type is known from Application Ser. No. 570,137, filed Jan. 12, 1984, now pending. This package has a rip-open tag fastened like a flap to the welded-seam closure to facilitate opening by hand. The tag is easy to grasp and makes it possible to rip out the seam and open the package without special additional means.

SUMMARY OF THE INVENTION

The object of the present invention is to provide a package of the aforesaid type that is even easier to open and that in particular will be cheaper to manufacture with respect to the costs of materials.

This object is attained in accordance with the invention in that at least one side of the welded-seam closure has a thickening that facilitates ripping into it or ripping it out. The thickening makes it considerably easier to grasp the seam and rip into it or rip it out.

This is especially true when the thickening is in the vicinity of at least one of the folded triangular flaps, specifically on the base of the folded triangular flap near a scored line on the side facing the package and specifically as near the peripheral edge of the seam as possible. A thickening applied in this way provides an especially satisfactory purchase for folding up the folded triangular flap and ripping out the tip of the flap, along a perforation if necessary, resulting in an excellent pouring spout of a known type.

An even more satisfactory grip can be attained when the thickening has an anti-slip surface, a tacky surface for example, of the type that can be obtained with a hot-melt coating. Another advantage of a hot-melt coating is that it can be precisely applied to the surface of the folded triangular flap without contact in the form of an area, dot, or streak while the package is moving along the production line on a conveyor.

When it is applied in the form of a streak, the hot-melt coating should extend essentially parallel to the peripheral edge of the welded-seam closure. This will not only facilitate applying the coating to a moving package. The intervention of force when the package is opened will also ensure the attachment of the coating to the folded triangular flap. Finally, it will provide an even more satisfactory grip if the surface is convex. The combination of thickening and slight surface adhesiveness will in fact improve the grip to the extent that enough force can be applied to rip into the welded-seam closure and rip it out.

In one practical embodiment of the invention, the thickening is applied to both the outside and the inside of the welded-seam closure. This makes it possible to simultaneously exploit the thickening on the inside of the closure to fasten the folded triangular flap to the wall of the package when the hot-melt streak is extended beyond the apex of the triangle.

Since it is practical not to apply the hot-melt thickening until the package has been filled, aseptically if desired, and closed, applying the thickening will in no way lead to contamination of the contents of the package.

Naturally, the thickening can be applied to each folded triangular flap to provide a grip for both right- and left-handed consumers.

Finally, it also conceivable to apply at least one more thickening to the base of the folded triangular flap in relation to the scored line on the side of the welded-seam closure facing the thickening in the flap and, if necessary, to provide the seam with a notch, perforation, or similar structure. The thickening in the vicinity of the flap can then be utilized to rip out the flap and the thickening in the remaining portion of the seam subsequently employed to completely open the package by ripping open the seam along a perforated line.

Some preferred embodiments of the invention will now be described with reference to the accompanying drawings, wherein

DETAILED DESCRIPTION OF THE PREFERRED EMBODIMENTS

Figure 1:
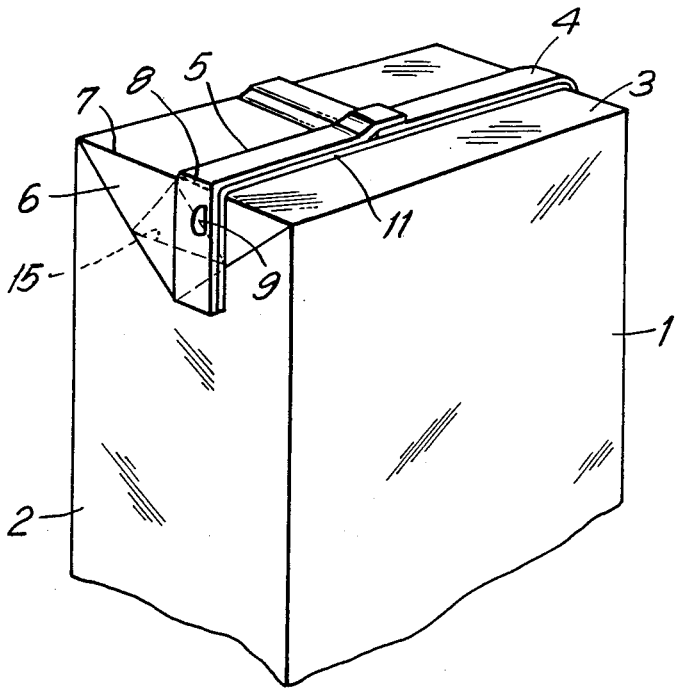
FIG. 1 is a perspective view of an unopened package with folded triangular flaps folded down against its walls.

The package illustrated in FIG. 1 has four walls, of which only front wall 1 and one side wall 2 are illustrated. The package also has an upper surface 3 and a bottom surface that is not visible in the drawing. The package is made for example out of a blank of plastic-coated cardboard lined with aluminum foil and scored both longitudinally and transversely along what will be the edges of the folded package.

When the package is full, it is sealed at the top along a welded-seam closure 4 that rests on a base line 5 on the upper surface 3 of the package. At each end of welded-seam closure 4 is a folded triangular flap 6, only the one on the forward side wall 2 being visible in FIG. 1. Triangular flaps 6 are folded down against the side of the package along with the associated ends of welded-seam closure 4 and attached to side wall 2 with an adhesive attachment that is easy to release. Triangular flaps 6 are folded down around the edge 7 of side wall 2. Wall edge 7 continues through welded-seam closure 4 in the form of a scored line 8. Between scored line 8 and the free end of welded-seam closure 4 is a grip for opening the package in the form of a thickening 9. Thickening 9 is located in the vicinities of scored line 8 and of one peripheral edge 11 of welded-seam closure 4. Since it consists of a hot-melt coating, the thickening has an anti-slip, tacky for example, surface. The hot-melt coating in the illustrated embodiment is a streak that parallels the edge of the welded-seam closure 4 and has a convex surface.

Figure 2:
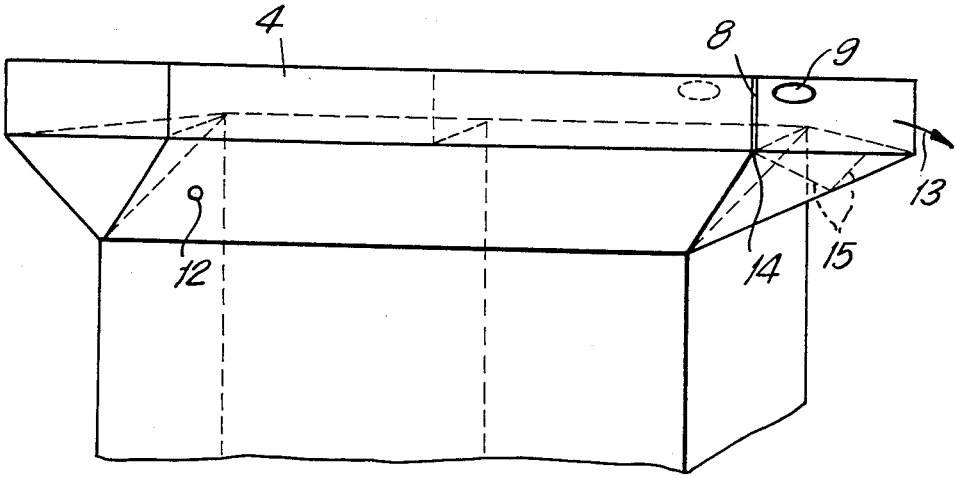
FIG. 2 illustrates the top of the package with the welded-seam closure erect.

The package can have an air hole 12 if desired. The package is opened, with welded-seam closure 4 erect as illustrated in FIG. 2, by grasping the outer end of the closure in the vicinity of thickening 9 and displacing it in the direction indicated by arrow 13 until a tilting motion is generated in the plane of welded-seam closure 4 around a point 14, producing a rip along and coincident with the scored line 8 in welded-seam closure 4. Folded triangular flap 6 is then preferably ripped off along a perforated line 15, resulting in a smooth-edged pouring spout..

Figure 4:
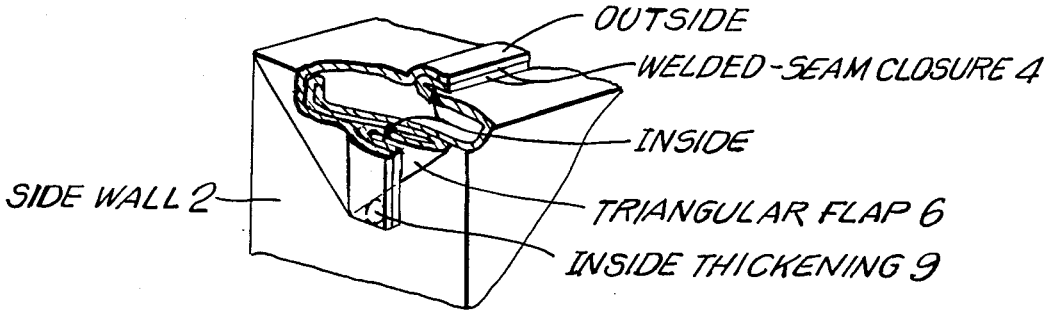
FIG. 4 is a partial sectional view of another embodiment.

A thickening 9 can be applied not only to the outside but also to the inside of welded-seam closure 4 as shown in FIG. 4. When such an additional thickening is appropriately positioned, it can also be exploited to fasten folded triangular flap 6 to the wall of the package.

It is also possible to position a thickening not only in the outer area of welded-seam closure 4 but also inside the closure with respect to scored line 8 as represented by the broken line in FIG. 2. This makes it possible to rip into and rip out the outer portion of welded-seam closure 4 as described in the foregoing and then utilize the additional thickening to rip off the whole closure along a perforation, not illustrated, that parallels base line 5, producing a larger pouring spout, which is an advantage when the contents of the package are lumps or pellets.

Figure 3:
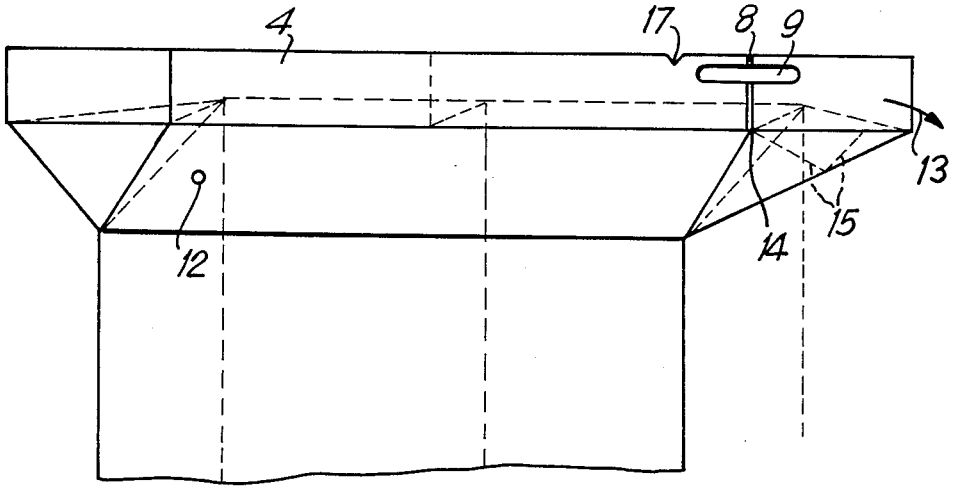
FIG. 3 is a similar view of another embodiment.

A larger pouring spout can also be obtained with a similar perforation when welded-seam closure 4 has an incision, notch 17, or similar structure and hot-melt thickening 9 extends beyond scored line 8 toward notch 17 as illustrated in FIG. 3.

It is understood that the specification and examples are illustrative but not limitative of the present invention and that other embodiments within the spirit and scope of the invention will suggest themselves to those skilled in the art.

I claim:

1. In a parallelepipedal package having an upper surface and side walls and made by folding and sealing a scored blank of a sheet material, the package having a welded-seam closure at the upper surface and triangular flaps foldable down against the side walls, the improvement wherein at least one side of the welded-seam closure has a thickening comprising a hot melt coating and having a convex and tacky surface that facilitates ripping into the closure or ripping the closure out.

2. A package according to claim 1, wherein the thickening is in the vicinity of at least one of the folded triangular flaps.

3. A package according to claim 1, wherein the triangular flaps each have a base adjacent the upper surface and a side facing a side wall when folded and wherein the thickening is at the base of one of the triangular flaps near a scored line on the side facing the side wall.

4. A package according to claim 3, wherein the folded-seam closure extends over the triangular flaps and the thickening is immediately adjacent the welded-seam.

5. A package according to claim 1, wherein the thickening is in the form of a dot.

6. A package according to claim 1, wherein the thickening is in the form of a streak.

7. A package according to claim 6, wherein the streak extends parallel to a peripheral edge of the welded-seam closure.

8. A package according to claim 1, wherein the welded-seam closure has two sides and the thickening is present on both sides of the welded-seam closure.

9. A package according to claim 1, wherein the welded-seam closure extends over the triangular flaps and has an inside surface when the triangular flaps are folded down and the thickening is on the inside surface of the closure at one flap and also serves to fasten the one folded triangular flap to the side wall of the package.

10. A package according to claim 1, wherein the welded-seam closure extends over the triangular flaps and the flaps have a base adjacent the upper surface and further comprising a scored line on the welded-seam closure superposed on the base of at least one triangular flap when folded, wherein the thickening is on one side of the scored line and further comprising at least one more thickening on the other side of the scored line.

11. A package according to claim 1, wherein the seam is provided with one of an incision, notch and perforation to facilitate rupture.

12. The package according to claim 1, wherein the sheet material comprises plastic coated cardboard.

13. In a parallelepipedal package having an upper surface and side walls and made by folding and sealing a scored blank of a sheet material, the package having a welded-seam closure at the upper surface and triangular flaps foldable down against the side walls, the improvement wherein at least one side of the welded-seam closure has a thickening having a convex and tacky surface that facilitates ripping into the closure or ripping the closure out, wherein the welded-seam closure extends over the triangular flaps and has an inside surface when the triangular flaps are folded down and the thickening is on the inside surface of the closure at one flap and also serves to fasten the one folded triangular flap to the side wall of the package.

14. In a parallelepipedal package having an upper surface and side walls and made by folding and sealing a scored blank of a sheet material, the package having a welded-seam closure at the upper surface and triangular flaps foldable down against the side walls, the improvement wherein the sheet material comprises plastic coated cardboard, at least one side of the welded-seam closure has a thickening comprising a dot of hot melt coating having a convex and tacky surface that facilitates ripping into the closure or ripping the closure out.

15. In a parallelepipedal package having an upper surface and side walls and made by folding and sealing a scored blank of a sheet material, the package having a welded-seam closure at the upper surface and triangular flaps foldable down against the side walls, the improvement wherein at least one side of the welded-seam closure has a thickening having a convex and tacky surface that facilitates ripping into the closure or ripping the closure out, wherein the welded-seam closure extends over the triangular flaps and the flaps have a base adjacent the upper surface and further comprising a scored line on the welded-seam closure superposed on the base of at least one triangular flap when folded, wherein the thickening is on one side of the scored line and further comprising at least one or more thickening on the other side of the scored line.

* * * * *